US005575906A

United States Patent [19]

Hommeltoft et al.

[11] Patent Number: 5,575,906

[45] Date of Patent: Nov. 19, 1996

[54] PROCESS FOR THE ELECTROCHEMICAL FLUORINATION OF A HYDROCARBON SUBSTRATE

[75] Inventors: Sven I. Hommeltoft, Hillerød; Ole Ekelund, Lyngby, both of Denmark

[73] Assignee: Haldor Topsøe A/S, Denmark

[21] Appl. No.: 497,649

[22] Filed: Jun. 30, 1995

[30] Foreign Application Priority Data

Jul. 1, 1994 [DK] Denmark ..... 0786/94

[51] Int. Cl.[6] ..... C25B 3/08

[52] U.S. Cl. ..... 205/460; 205/461

[58] Field of Search ..... 204/59 R, 59 F, 204/81

[56] References Cited

U.S. PATENT DOCUMENTS

| | | | |
|---|---|---|---|
| 3,887,439 | 6/1975 | Hutchinson | 203/63 |
| 5,318,674 | 6/1994 | Behr et al. | 204/59 F |
| 5,322,597 | 6/1994 | Childs et al. | 205/430 |

FOREIGN PATENT DOCUMENTS

| | | |
|---|---|---|
| 3296412 | 4/1990 | Japan . |
| 92232289 | 8/1992 | Japan . |

OTHER PUBLICATIONS

F. G. Drakesmith, D. A. Hughes, J. Appl. Electrochem., 9 no month (1979), pp. 685–697.

Hollitzer and Sartori, J. Fluorine Chem., 35 no month (1987), pp. 329–341.

Gramstad and Haszeldine, J. Echem.–Soc., no month 1957, pp. 2640–2645.

*Primary Examiner*—Kathryn Gorgos
*Assistant Examiner*—Edna Wong
*Attorney, Agent, or Firm*—Ostrolenk, Faber, Gerb & Soffen, LLP

[57] ABSTRACT

Process for the electrochemical fluorination of a hydrocarbon substrate in the presence of a HF-containing electrolyte under electrochemical fluorination conditions to a fluorinated product and a hydrogen gas by-product, the improvement of which comprises additional steps of (a) continuously separating the formed fluorinated product from the electrolyte by extracting the electrolyte with an extraction agent, (b) continuously separating residual amounts of the fluorinated product from the hydrogen gas by-product by extraction of the gas with an extraction agent; and (c) recovering the fluorinated product by distillation of the extraction agent from step (a) and step (b).

6 Claims, 1 Drawing Sheet

PROCESS FOR THE ELECTROCHEMICAL FLUORINATION OF A HYDROCARBON SUBSTRATE

The present invention is directed to a process for the preparation of fluoro-hydrocarbons by electrochemical fluorination (ECF), and more particular to improvements of such process by extraction of perfluorinated products from an electrolyte employed during ECF and the hydrogen gas formed as by-product during the process.

BACKGROUND OF THE INVENTION

It is known that volatile products such as perfluoromethanesulphonyl fluoride or perfluroethanesulphonyl fluoride may be recovered from the electrolyte used in ECF together with formed hydrogen by distillation. The product has thereby to be separated from hydrogen, which is a troublesome process step when working in industrial scale. A further disadvantage of this method is loss of HF from the electrolyte due to evaporation from the electrochemical cell, even if the cell is provided with a reflux condenser.

U.S. Pat. No. 5,322,597 discloses a process for separating perfluorinated products from the electrolyte in ECF by extraction. In the case of volatile products (e.g. perfluoromethanesulphonyl fluoride) experiments have shown that extraction of the electrolyte is not sufficient in order to separate hydrogen and product effectively. A considerably amount of the product is flushed out of the process mixture with hydrogen gas because of the high vapour pressure of the product.

It is further known to precipitate the product directly from the electrolyte, if the product has a low solubility in HF at the employed temperatures (F. G. Drakesmith, D. A. Hughes, J. Appl. Electrochem., 9 (1979), p. 685; DE Patent No. 4,218,562 and JP Patent Application No. 92,232,289).

Under usual electrolysis conditions, it is only possible to precipitate perfluoro-n-alkanesulphonyl fluorides with more than 4 carbon atoms. Lower alkanesulphonyl fluorides can only be separated by excessive cooling of the product solution, which demands very low temperatures and complicates the process. Precipitation results furthermore in saturation of the electrolyte with perfluorinated product. Hollitzer and Sartori (J. Fluorine Chem., 35 (1987), 329–341) have shown that during synthesis of perfluropropanesulphonyl fluoride high product yields cannot be obtained, when the product is accumulated in the cell after formation due to decomposition reactions of the product. Gramstad and Haszeldine (J. Chem.- Soc., 1957, p. 2640) have additionally observed decomposition of C—C and C-S-bindings during ECF of alkanesulphonyl fluorides.

It is thus necessary to keep the concentration of dissolved products by the electrolyte as low as possible, which is not possible by the above precipitation method.

DESCRIPTION OF THE INVENTION

The general object of this invention is to improve the known methods for the electrochemical fluorination by continuously removing formed perfluorinated products from the electrolyte and from the hydrogen gas by-product through extraction with an appropriate extraction agent. The perfluorinated product is subsequently recovered from the extraction agent by distillation.

Accordingly, the invention provides a process for the electrochemical fluorination of a hydrocarbon substrate in the presence of a HF-containing electrolyte under electrochemical fluorination conditions to a fluorinated product and a hydrogen gas by-product, the improvement of which comprises additional steps of (a) continuously separating the formed fluorinated product from the electrolyte by extracting the electrolyte with an extraction agent, (b) continuously separating residual amounts of the fluorinated product from the hydrogen gas by-product by extraction of the gas with an extraction agent; and (c) recovering the fluorinated product by distillation of the extraction agent from step (a) and step (b).

When operating the invention in praxis, an inert extraction agent is passed at electrolysis conditions either through the electrolysis cell, wherein the electrochemical fluorination is performed, or by passing the electrolyte, which contains the fluorinated product through an external extraction unit, and extracting the electrolyte with the extraction agent.

Through continuous removal of the product from the electrolyte, the product activity in the electrolyte is maintained at low level resulting in low decomposition rate and high product yield.

When carrying out the process in industrial scale, an electrolyte substream or optionally the total stream is withdrawn from a circulating stream of the electrolyte, which passes between the electrolysis cell and an evaporation chamber for the removal of hydrogen, being formed during ECF. The substream is extracted with an appropriate extraction agent. As an example, the extraction can be carried out in a packed column, wherein the electrolyte is extracted with a countercurrent stream of the agent. The extraction can furthermore be performed by thoroughly mixing the electrolyte and the solvent in e.g. a centrifugal pump, and subsequent separation of electrolyte and extraction agent.

The extraction agent containing the perfluorinated product is pumped to a distillation column. If the product is more volatile than the extraction agent, the product is distilled off and the agent is recycled from the bottom of the distillation column. When the solvent is the most volatile compound, it is distilled off and after condensation and cooling, recycled to the extraction column. The product is then withdrawn from the bottom of the distillation column. In both cases the extraction agent can be employed for extraction of the hydrogen gas stream after cooling for recovery of flushed products from the gas stream. After distillation, the agent is recycled to the extraction column. Having passed through the extraction column, the electrolyte is conveyed back to the cycle with electrolysis cell.

The invention is, in particular, useful for the preparation of perfluoroalkanesulphonyl fluorides by electrochemical fluorination of corresponding alkanesulphonyl fluorides. The prepared fluoroalkanesulphonyl fluorides are extracted continuously from the electrolyte by an inert extraction agent of perfluorinated compounds, which are immiscible with the electrolyte such as perfluordecaline, perfluorooctane, perfluoro-octyl sulphonyl fluoride or mixtures thereof.

Certain aspects and features of the invention are described more detailed in the following Examples in comparison with the known technique and illustrated in the appended drawing.

BRIEF DESCRIPTION OF THE DRAWING

The sole drawing figure is a diagrammatic representation of the process of this invention.

Comparison Example

Figure 1:
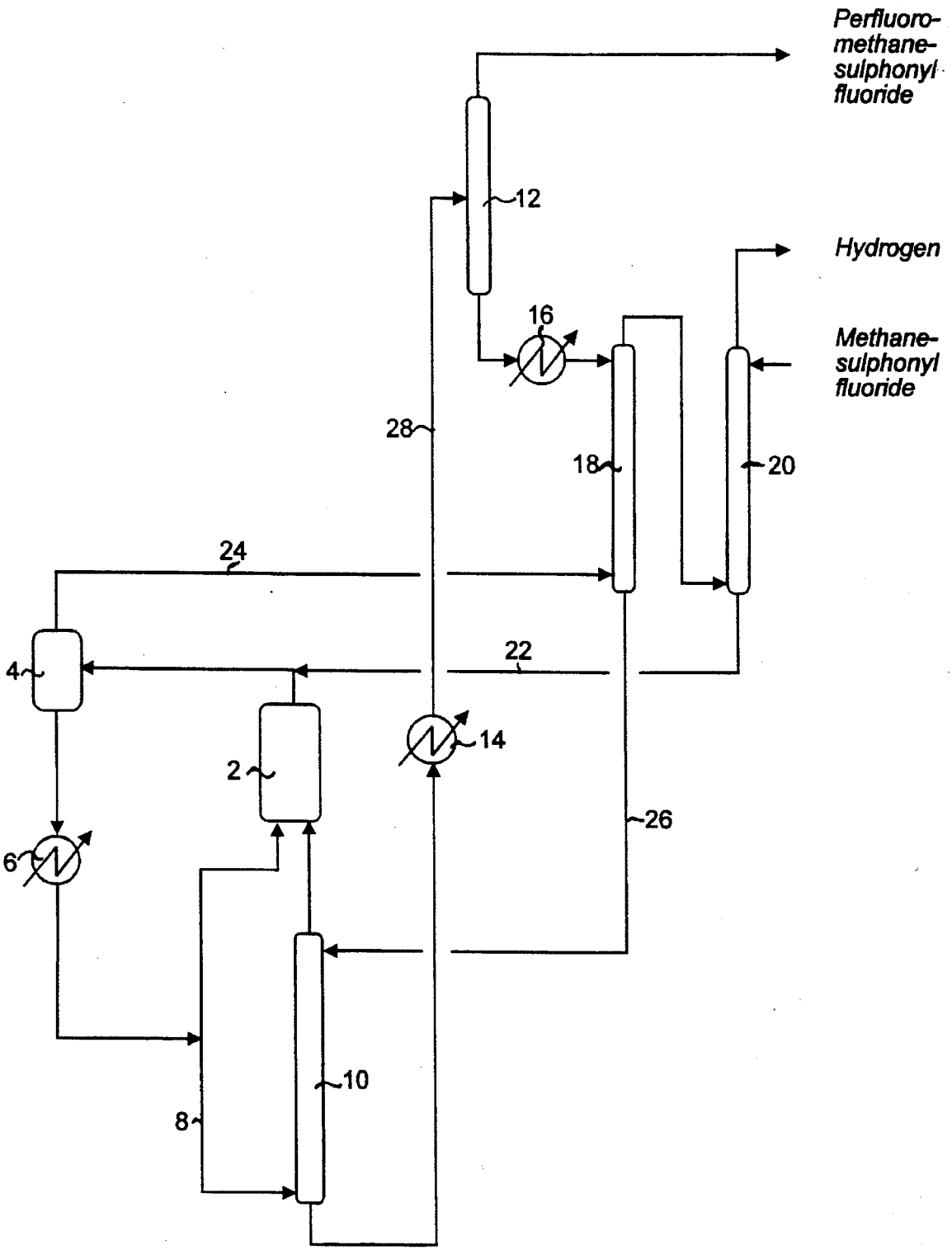

Electrochemical preparation of perfluoropropanesulphonyl fluoride according to known technique.

27.2 g propanesulphonyl fluoride were introduced into an electrolysis cell containing 600 ml HF (1). The cell was equipped with a nickelanode and cathode having a surface area of 970 $cm^2$.

HF (g) evaporation from the cell was reduced by a reflux-condenser arranged on top of the cell. The gas from the condenser was passed through an aqueous solution of potassium iodide for the removal of HF and oxidizing gases and dried subsequently by passage through a calcium chloride bed. Volatile compounds were condensed in an acetone/dry-ice trap.

The electrolysis was carried out at 5.5–5.6 V. After 20.15 hours when 88.0 Ah have passed, the electrolysis was interrupted. The theoretical yield was 54.4 g perfluoropropanesulphonyl fluoride (bp. 37° C.). No product precipitated in the cell at 15° C. After cooling of the reaction mixture with acetone/dry-ice only small amounts of volatile product have been removed from the cooling trap.

Perfluoropropanesulphonyl fluoride has a high solubility in HF (1), and the product cannot be precipitated at the above conditions. Perfluoropropanesulphonyl fluoride has a boiling point of 17° C. higher than HF (1) and only insignificant amounts of product were withdrawn from the condenser.

Example 1

Electrochemical preparation of perfluoropropanesulphonyl fluoride according to a specific embodiment of the invention.

ECF of propanesulphonyl fluoride was performed in an electrolysis assembly with an external electrolyte circuit, an evaporation chamber and an extraction column. The electrolyte was circulated by a pump between the electrolysis cell and the evaporation chamber. The temperature of the electrolyte was maintained at 8° C. by heat exchange with a cooling agent. A substream from the circuit was withdrawn for countercurrent extraction in the extraction column, which was loaded with filler bodies in form of steel rings. After the extraction, the electrolyte was recirculated to the cell. Perfluorodecalin (bp. 141° C.) was used as extraction agent in the extraction. After passage through the extraction column, the agent was heated to a temperature of about 130° C. and introduced into the distillation column, where the extracted product was distilled off. The extraction agent was recirculated via a cooler to the extraction column at a temperature of about 15° C. Distilled off amounts of product were collected at −78° C. in an acetone/dry-ice trap. Hydrogen was separated in the evaporation chamber, and was washed with an aqueous solution of calcium iodide for removal of HF and oxidizing gases. Separated hydrogen was then dried by passage through a calcium chloride bed and residual amounts of products in the gas condensed in a cooling trap at −78° C.

By the above process 36.55 g propanesulphonyl fluoride have been electrofluorinated. The electrolysis was performed at about 4.8 V and at a constant current of 8 A. From the distillation column, wherein the product is separated from the extraction agent, 57.8 g (79.1%) perfluoropropanesulphonyl fluoride were condensed after the electrolysis, and from the hydrogen gas stream were condensed 8.8 g (12%) product. The total yield was then 91.1%.

Example 2

Methanesulphonyl fluoride was electrochemical fluorinated to trifluoromethanesulphonyl fluoride in an ECF unit shown in FIG. 1. Perfluorodecalin was applied as extraction agent.

The electrolyte was circulated between an ECF cell 2, a gas/liquid separator 4 and a cooler 6. A side stream 8 of the electrolyte was passed through extraction column 10 and subsequently recycled to cell 2. The electrolyte was maintained at a temperature of 10° C. Perfluorodecalin extraction agent was passed countercurrently to the electrolyte through extraction column 10. From column 10, the extraction agent was heated to 130° C. in heater 14 and transferred in line 28 to a distillation column 12, wherein perfluoromethanesulphonyl fluoride was distilled off and subsequently condensed at −78° C. in an acetone/dry-ice trap (not shown). Perfluorodecalin extraction agent was cooled in cooler 16 and transferred to a hydrogen gas extraction column 18, where perfluoromethanesulphonyl fluoride was extracted from hydrogen gas 24. From the bottom of column 18, the extraction agent was recycled in line 26 to electrolyte extraction column 10. The extracted hydrogen gas was subsequently passed to an absorption column 20, where the gas was passed countercurrently to methane sulphonylfluoride in order to absorb HF, which was flushed out of the electrolyte. From the bottom of column 20, methanesulphonyl fluoride was passed in line 22 to separator 4. The purified hydrogen gas was passed through a cooling trap at −78° C. in order to condense residual amounts of perfluoromethanesulphonyl fluoride, which have been flushed from absorption column 20.

Methanesulphonyl fluoride was continuously introduced into HF-absorption column 20 at a flow rate of 6.1 g/h. The electrochemical fluorination was performed at a constant current density of 0.88 $MA/cm^2$ and a potential of 4.8–5.5 V.

After 40 hours, 244 g of methanesulponyl fluoride have been added and the addition was stopped. After 43 h, the electrolysis process was interrupted. Only insignificant amounts of perfluoromethanesulphonyl fluoride were collected from the hydrogen gas. 359 g (95% yield) of perfluoromethanesulphonyl fluoride were recovered in the product trap. The current yield was 93%.

We claim:

1. In a process for the electrochemical fluorination of a hydrocarbon substrate a HF-containing electrolyte under electrochemical fluorination conditions to a fluorinated product and a hydrogen gas by-product, the improvement of which comprises additional steps of (a) continuously separating the formed fluorinated product from the electrolyte by extracting the electrolyte with an extraction agent comprised of perfluorinated compounds, which are immiscible with the electrolyte, (b) continuously separating residual amounts of the fluorinated product from the hydrogen gas by-product by extraction of the gas with an extraction agent comprised of perfluorinated compounds, which are immiscible with the electrolyte; and (c) recovering the fluorinated product by distillation of the extraction agent from step (a) and step (b).

2. The process of claim 1, wherein the substrate is alkanesulphonyl fluoride.

3. The process of claim 1, wherein the substrate consists of tetramethylenesulfone.

4. The process of claim 1, wherein the extraction agent comprises perfluoroalkanes, which are immiscible with the electrolyte.

5. The process of claim 1, wherein the extraction agent comprises perfluorodecalin.

6. The process of claim 1, further comprising the step of removing residual amounts of HF in the extracted hydrogen gas from step (b) by scrubbing the gas from step (b) with the hydrocarbon substrate.

* * * * *